US011326601B2

(12) United States Patent
Sato et al.

(10) Patent No.: US 11,326,601 B2
(45) Date of Patent: May 10, 2022

(54) SCROLL FLUID MACHINE AND SCROLL MEMBER USED THEREIN

(71) Applicant: MITSUBISHI HEAVY INDUSTRIES THERMAL SYSTEMS, LTD., Tokyo (JP)

(72) Inventors: Hajime Sato, Tokyo (JP); Yoshiyuki Kimata, Tokyo (JP); Takahide Ito, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 29 days.

(21) Appl. No.: 16/960,282

(22) PCT Filed: Jan. 15, 2019

(86) PCT No.: PCT/JP2019/000898
§ 371 (c)(1),
(2) Date: Jul. 6, 2020

(87) PCT Pub. No.: WO2019/163331
PCT Pub. Date: Aug. 29, 2019

(65) Prior Publication Data

US 2021/0071662 A1 Mar. 11, 2021

(30) Foreign Application Priority Data

Feb. 21, 2018 (JP) ..... JP2018-028958

(51) Int. Cl.
*F04C 18/02* (2006.01)
*F04C 27/00* (2006.01)

(52) U.S. Cl.
CPC ..... *F04C 18/0215* (2013.01); *F04C 27/001* (2013.01)

(58) Field of Classification Search
CPC ..... F04C 18/0215; F04C 18/0253; F04C 18/0276; F04C 2/025; F04C 27/001;
(Continued)

(56) References Cited

U.S. PATENT DOCUMENTS 4,548,555 A 10/1985 Hiraga et al.
5,474,433 A * 12/1995 Chang ..... F04C 18/0215 418/55.4

(Continued)

FOREIGN PATENT DOCUMENTS

CN 102052302 A 5/2011
CN 204003446 U 12/2014

(Continued)

OTHER PUBLICATIONS

Australian Office Action for Australian Application No. 2019225277, dated Sep. 11, 2020.

(Continued)

*Primary Examiner* — Audrey B. Walter
*Assistant Examiner* — Dapinder Singh
(74) *Attorney, Agent, or Firm* — Birch, Stewart, Kolasch & Birch, LLP

(57) ABSTRACT

In a scroll compressor (1) provided with a fixed scroll (3) and an orbiting scroll (5), an inclined portion is provided in which the inter-facing surface distance (L) between an end plate (3*a*) and an end plate (5*a*) that face each other decreases continuously from the outer peripheral side towards the inner peripheral side. The inclined portion is configured from wall inclined portions (3*b*1, 5*b*1) in which the height of a wall (3*b*, 5*b*) decreases continuously from the outer peripheral side towards the inner peripheral side, and end plate inclined portions (3*a*1, 5*a*1) in which a tooth bottom surface is inclined in accordance with the incline of the wall inclined portions (3*b*1, 5*b*1). The inclined portion is (Continued)

provided across a range of no less than 180° around the center of the spiral.

7 Claims, 10 Drawing Sheets

(58) Field of Classification Search
CPC ..... F04C 29/0028; F04C 2230/91; F04C 2230/602; F04C 2270/17; F04C 2270/04; F04C 2210/26; F05B 2210/14; F05B 2240/20
See application file for complete search history.

(56) References Cited

U.S. PATENT DOCUMENTS 5,496,161 A 3/1996 Machida et al.
5,829,959 A * 11/1998 Tsubono ..... F04C 18/0269 418/55.5
5,857,844 A * 1/1999 Lifson ..... F04C 18/0276 418/1
2010/0202911 A1* 8/2010 Ni ..... B29C 45/14836 418/55.2
2015/0369244 A1* 12/2015 Stoop ..... F04C 18/0246 418/55.2
2020/0370556 A1 11/2020 Sato et al.

FOREIGN PATENT DOCUMENTS

| | | | |
|---|---|---|---|
| EP | 3444475 | A1 | 2/2019 |
| JP | 60-17956 | B2 | 5/1985 |
| JP | 2009-228476 | A | 10/2009 |
| JP | 2010-196663 | A | 9/2010 |
| JP | 2015-55173 | A | 3/2015 |
| JP | 2018-28300 | A | 2/2018 |
| WO | WO 2018/034273 | A1 | 2/2018 |

OTHER PUBLICATIONS

Extended European Search Report for European Application No. 19757551.7, dated Feb. 12, 2021.
Japanese Office Action for Japanese Application No. 2018-028958, dated Mar. 5, 2019, with English translation.
Written Opinion of the International Searching Authority and International Search Report for International Application No. PCT/JP2019/000898, dated Mar. 12, 2019, with English translations.

* cited by examiner

SCROLL FLUID MACHINE AND SCROLL MEMBER USED THEREIN

TECHNICAL FIELD

The present invention relates to a scroll fluid machine and a scroll member used therein.

BACKGROUND ART

In general, a scroll fluid machine is known, in which a fixed scroll member and an orbiting scroll member each having a spiral wall provided on an end plate mesh with each other so as to perform a revolution orbiting movement and a fluid is compressed or expanded.

As such a scroll fluid machine, a so-called stepped scroll compressor as shown in PTL 1 is known. In the stepped scroll compressor, step portions are provided at positions of tooth tip surfaces and tooth bottom surfaces of spiral walls of a fixed scroll and an orbiting scroll in a spiral direction and a height on an outer peripheral side of each wall is higher than a height on an inner peripheral side thereof with each step portion as a boundary. In the stepped scroll compressor, compression (three-dimensional compression) is performed not only in a circumferential direction of the wall but also in a height direction thereof, and thus, compared to a general scroll compressor (two-dimensional compression) which does not include the step portion, the amount of displacement can be increased, and thus, the compressor capacity can be increased.

CITATION LIST

Patent Literature

[PTL 1] Japanese Unexamined Patent Application Publication No. 2015-55173

SUMMARY OF INVENTION

Technical Problem

However, in the stepped scroll compressor, there is a problem that fluid leakage in a step portion is large. Additionally, there is a problem that stress concentrates on a base portion of the step portion and strength decreases.

The present invention has been made in view of such circumstances, and an object thereof is to provide a scroll fluid machine which can realize three-dimensional compression or three-dimensional expansion without using a step portion as in a stepped scroll fluid machine, and a scroll member used therein.

Solution to Problem

In order to solve the above problems, a scroll fluid machine and a scroll member used therein according to the present invention adopt the following means.

That is, a scroll fluid machine according to an aspect of the present invention is a scroll fluid machine including a first scroll member having a first end plate on which a spiral first wall is provided; a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, and each of the inclined portions is provided over a range of 180° or more around a center of the spiral.

Since the inclined portion in which the inter-facing surface distance between the first end plate and the second end plate continuously decreases from the outer peripheral side to the inner peripheral side of each wall is provided, the fluid sucked from the outer peripheral side is not only compressed due to the decrease of a compression chamber according to the spiral shape of the wall toward the inner peripheral side, but also further compression will occur due to the decrease in the inter-facing surface distance between the end plates. As a result, three-dimensional compression becomes possible and size reduction can be realized.

Moreover, since the inclined portion decreases continuously, the fluid leakage can be reduced as compared to the related-art stepped scroll fluid machine in which the step portions are provided on the walls and the tooth bottoms.

The continuously inclined portion is not limited to a smoothly connected inclined portion but also includes an inclined portion in which small steps are connected in a staircase and the inclined portion is continuously inclined as a whole.

Moreover, according to the scroll fluid machine of the aspect of the present invention, at least one of the first wall and the second wall has a wall inclined portion in which a height of the wall continuously decreases from the outer peripheral side toward the inner peripheral side so as to form the inclined portion, and at least one of the first end plate and the second end plate has an end plate inclined portion in which a tooth bottom surface facing a tooth tip of the wall inclined portion is inclined in accordance with an inclination of the wall inclined portion.

By providing the wall inclined portion in which the height of the wall decreases from the outer peripheral side toward the inner peripheral side, and the end plate inclined portion in which the tooth bottom surface facing the tooth tip of the wall inclined portion is inclined in accordance with the inclination of the wall inclined portion, it is possible to form the inclined portion in which the inter-facing surface distance between the end plates decreases from the outer peripheral side toward the inner peripheral side.

The wall inclined portion and the end plate inclined portion may be provided on both sides of the first scroll and the second scroll or may be provided on either one of the scrolls. In a case where the wall on one side is provided with the wall inclined portion and the end plate on the other side is provided with the end plate inclined portion, the wall on the other side and an end plate on one side may be flat or may have a shape combined with the stepped shape of the related art.

Moreover, according to the scroll fluid machine of the aspect of the present invention, a tooth tip of each of the first wall and the second wall corresponding to the inclined portion is provided with a tip seal that comes into contact with a facing tooth bottom to seal a fluid.

In the inclined portion, if both the scroll members perform the revolution orbiting movement relative to each other, the positions of the tooth tip and the tooth bottom are deviated by an orbiting diameter (orbiting radius×2). The gap (tip clearance) between the tooth tip and the tooth bottom is changed due to the positional deviation between the tooth tip and the tooth bottom. In order to suppress the fluid leakage caused by the influence of this change in tip clearance, a tip seal is provided at the tooth tip of each wall corresponding to the inclined portion.

Moreover, according to the scroll fluid machine of the aspect of the present invention, a coating is applied to a tooth tip and/or a tooth bottom of the wall that constitutes the inclined portion.

By coating the tooth tip and/or the tooth bottom of the wall that constitutes the inclined portion, it is possible to compensate for the processing variation of the inclined portion, which is difficult to obtain the processing accuracy, by the thickness of a coating film. As a result, the fluid leakage can be suppressed.

Moreover, according to the scroll fluid machine of the aspect of the present invention, outermost peripheral portions and/or innermost peripheral portions of the first wall and the second wall are provided with a wall flat portion whose height does not change, and each of the first end plate and the second end plate is provided with an end plate flat portion corresponding to the wall flat portion.

If the tooth tip of the wall is inclined, it is difficult to set the measurement point and it is difficult to improve the measurement accuracy. Therefore, the flat portions are provided on the outermost peripheral portion and/or the innermost peripheral portion of each of the wall and the end plate, and the shape measurement is performed with high accuracy. This facilitates dimensional management of the scroll shape and the tip clearance management.

Moreover, according to the scroll fluid machine of the aspect of the present invention, the wall flat portion and the end plate flat portion are provided over a region of 180° around a center of the scroll member.

By providing the wall flat portion and the end plate flat portion over a region of 180°, it is possible to perform measurement on the flat portions on both sides across the center of each of the scroll members. As a result, the shape dimensions of the scroll members can be appropriately measured.

Additionally, if the range of the flat portions greatly exceeds 180°, the region of the inclined portion decrease and the inclination φ of the inclined portion becomes large. If the inclination becomes large, there is a possibility that the amount of change in the tip clearance caused by the orbiting diameter during the revolution orbiting movement becomes large and the fluid leakage increases. Therefore, it is preferable that the wall flat portion and the end plate flat portion are regions of 180°. However, 180° is not strict, and an angle slightly exceeding 180° is allowed within a range where the fluid leakage does not increase.

Moreover, according to the scroll fluid machine of the aspect of the present invention, an inclination of the inclined portion is constant with respect to a circumferential direction in which the spiral wall extends.

The inclination of the inclined portion is set to be constant with respect to the circumferential direction in which the spiral wall extends. As a result, the tip clearance caused by the orbiting diameter during the revolution orbiting movement can be made equal at the respective positions of the inclined portion, and the fluid leakage can be suppressed.

Moreover, according to the scroll fluid machine of the aspect of the present invention, an inclination of the inclined portion is set to be larger on the outer peripheral side than on the inner peripheral side with respect to a circumferential direction in which the spiral wall extends.

Since the pressure difference on the inner peripheral side is larger than that on the outer peripheral side, the fluid leakage is larger than that on the outer peripheral side. Since the pressure difference on the outer peripheral side is smaller than that on the inner peripheral side, the influence of the fluid leakage is low. Therefore, by setting then inclination of the inclined portion to be larger on the outer peripheral side than on the inner peripheral side with respect to the circumferential direction in which the spiral wall extends, the fluid leakage on the inner peripheral side is suppressed while suppressing the fluid leakage on the outer peripheral side to the necessary minimum. As a result, the volume ratio can be increased, and the amount of displacement can also be increased.

Additionally, a scroll member according to an aspect of the present invention is a scroll member used for a scroll fluid machine including an end plate and a spiral wall provided on the end plate, the wall has a wall inclined portion in which a height of the wall continuously decreases from an outer peripheral side toward an inner peripheral side, and the end plate has an end plate inclined portion in which a height of the end plate continuously increases from the outer peripheral side toward the inner peripheral side in accordance with a decrease in height of the wall inclined portion, and the wall inclined portion and the end plate inclined portion are provided over a range of 180° or more around a center of the spiral.

By using the scroll member having the wall inclined portion and the end plate inclined portion, it is possible to configure the scroll fluid machine in which the inter-facing surface distance between the end plates continuously decreases from the outer peripheral side toward the inner peripheral side.

Advantageous Effects of Invention

Since the inclined portion in which the inter-facing surface distance between the end plates continuously decreases from the outer peripheral side of each wall to the inner peripheral side thereof the is provided, three-dimensional compression or three-dimensional expansion is possible. Moreover, since the inclined portion continuously decreases and no step portion is provided unlike the stepped scroll fluid machine, it is possible to reduce the fluid leakage and the strength of the wall is not reduced.

DESCRIPTION OF EMBODIMENTS

Hereinafter, an embodiment according to the present invention will be described with reference to the drawings.

Figure 1A:
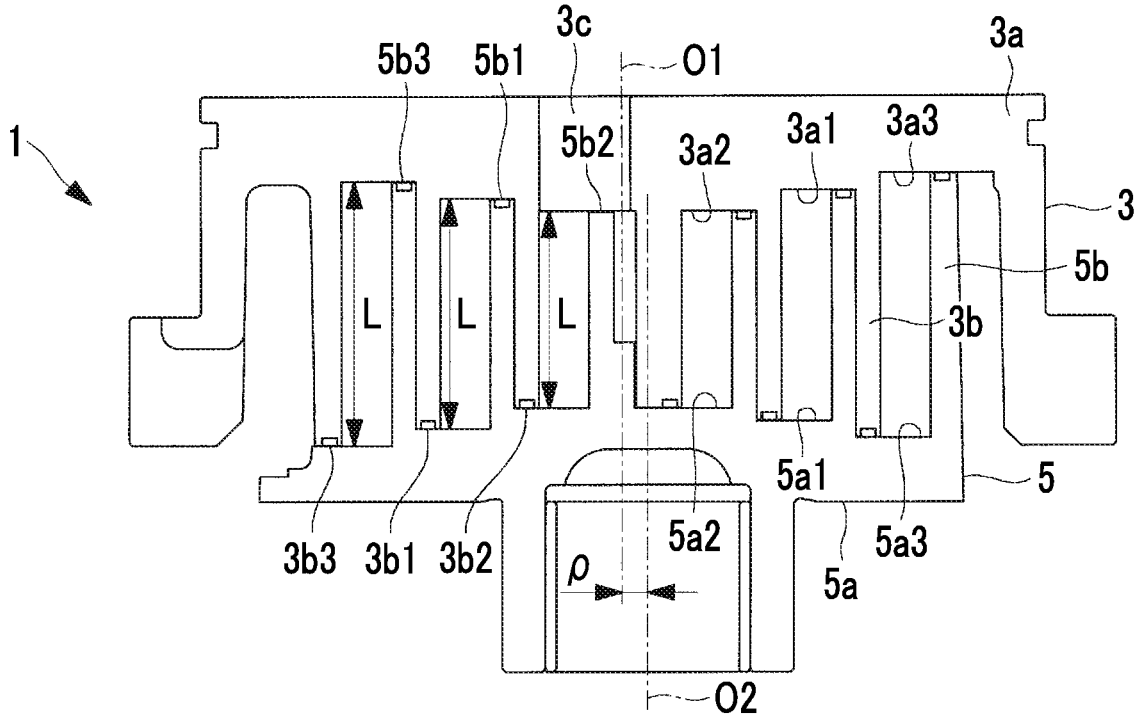
FIG. 1A is longitudinal sectional view showing a fixed scroll and an orbiting scroll of a scroll compressor according to an embodiment of the present invention.
Figure 1B:
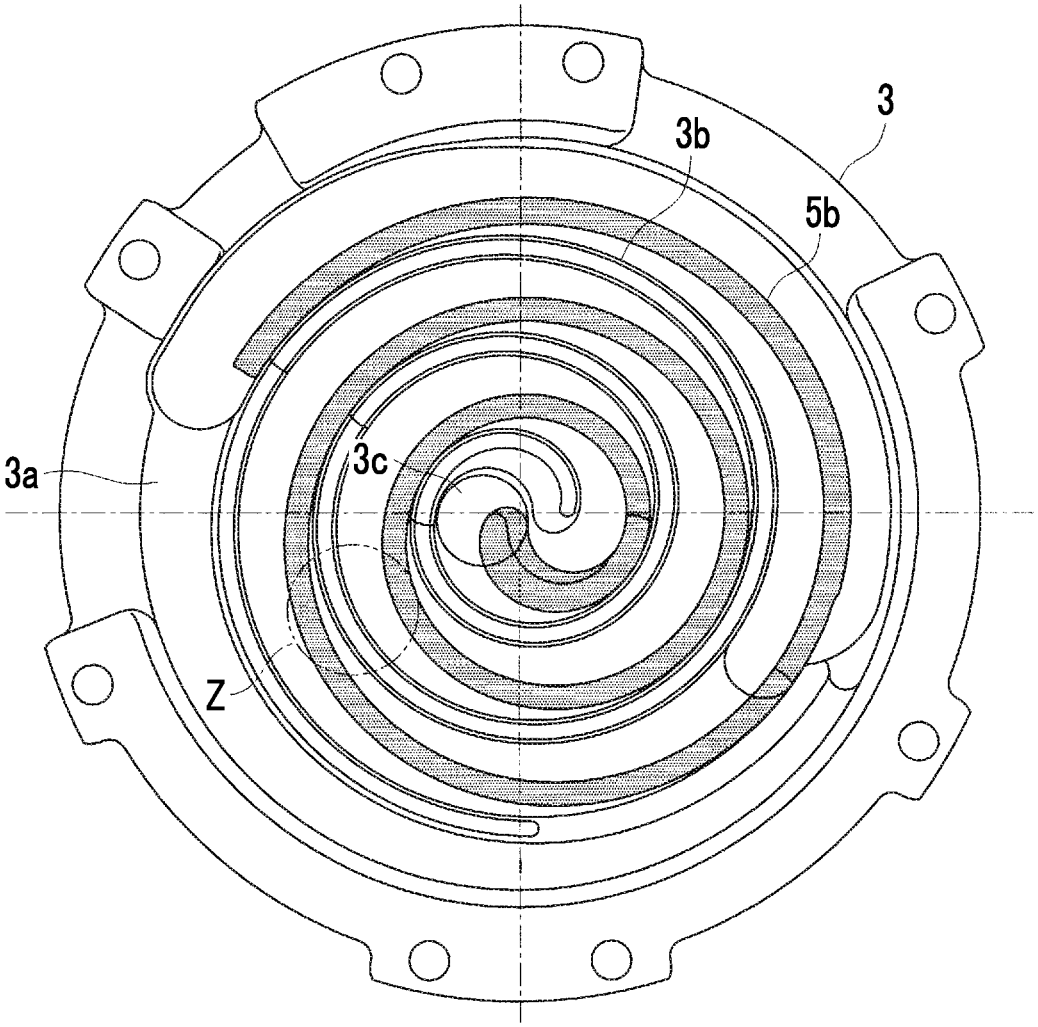
FIG. 1B is a plan view when the fixed scroll shown in FIG. 1A is viewed from a wall side.

In FIGS. 1A and 1B, a fixed scroll (first scroll member) 3 and an orbiting scroll (second scroll member) 5 of a scroll compressor (scroll fluid machine) 1 are shown. For example, the scroll compressor 1 is used as a compressor that compresses a gas refrigerant (fluid) which performs a refrigerating cycle of an air conditioner or the like.

Each of the fixed scroll 3 and the orbiting scroll 5 is a metal compression mechanism which is formed of an aluminum alloy or steel, and is accommodated in a housing (not shown). The fixed scroll 3 and the orbiting scroll 5 sucks a fluid, which is introduced into the housing, from an outer peripheral side, and discharge the compressed fluid from a discharge port 3*c* positioned at a center of the fixed scroll 3 to the outside.

The fixed scroll 3 is fixed to the housing, and as shown in FIG. 1A, includes an approximately disk-shaped end plate (first end plate) 3*a*, and a spiral wall (first wall) 3*b* which is erected on one side surface of the end plate 3*a*. The orbiting scroll 5 includes an approximately disk-shaped end plate (second end plate) 5*a* and a spiral wall (second wall) 5*b* which is erected on one side surface of the end plate 5*a*. For example, a spiral shape of each of the walls 3*b* and 5*b* is defined by using an involute curve or an Archimedes curve.

The fixed scroll 3 and the orbiting scroll 5 are assembled to each other such that centers thereof are separated from each other by an orbiting radius ρ, the walls 3*b* and 5*b* mesh with each other with phases deviated from each other by 180°, and a slight clearance (tip clearance) in a height direction is provided at the room temperature between tooth tips and tooth bottoms of the walls 3*b* and 5*b* of both scrolls. As a result, a plurality pairs of compression chambers which are formed to be surrounded by the end plates 3*a* and 5*a* and the walls 3*b* and 5*b* are symmetrically formed about a scroll center between both scrolls 3 and 5. The orbiting scroll 5 performs a revolution orbiting movement around the fixed scroll 3 by a rotation prevention mechanism such as an Oldham ring (not shown).

As shown in FIG. 1A, an inclined portion is provided, in which an inter-facing surface distance L between both end plates 3*a* and 5*a* facing each other continuously decrease from an outer peripheral sides of the spiral walls 3*b* and 5*b* toward inner peripheral sides thereof.

Figure 2:
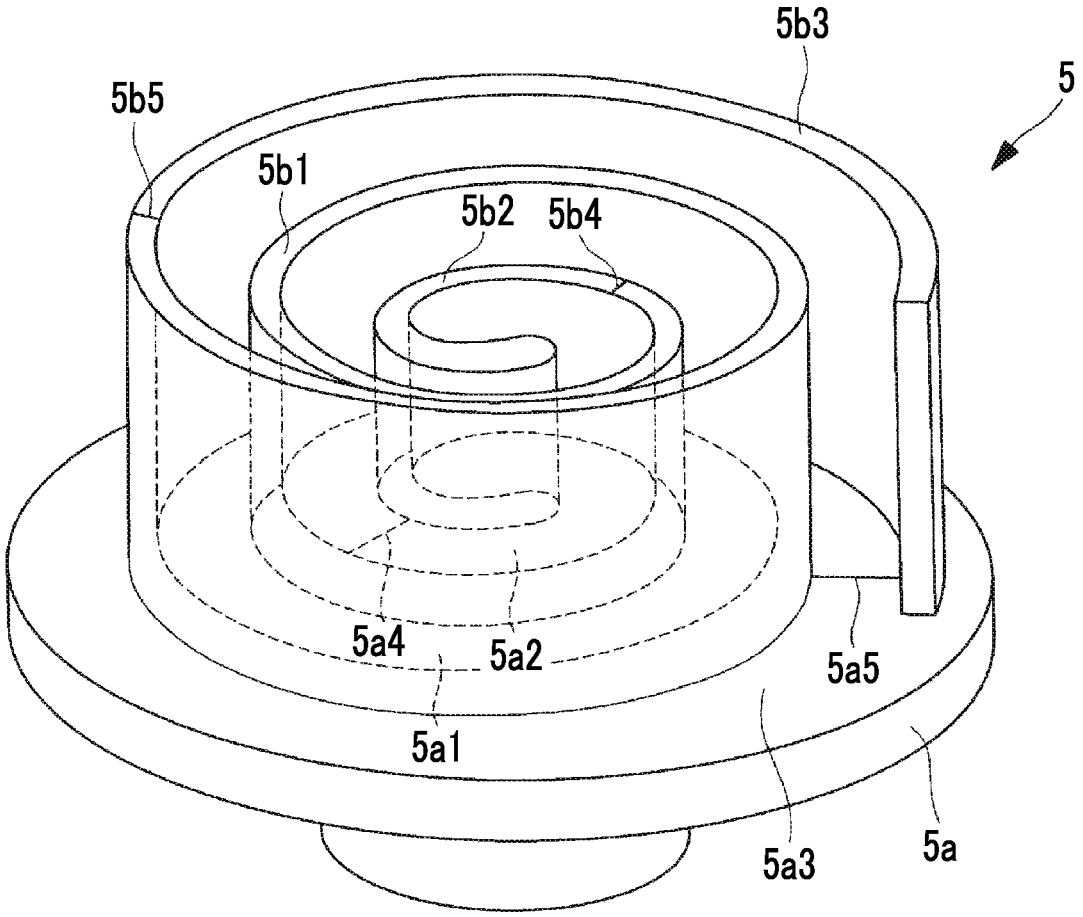
FIG. 2 is a perspective view showing the orbiting scroll of FIGS. 1A and 1B.

As shown in FIG. 2, the wall 5*b* of the orbiting scroll 5 is provided with a wall inclined portion 5*b*1 whose height continuously decreases from an outer peripheral side toward an inner peripheral side. A tooth bottom surface of the fixed scroll 3 facing a tooth tip of the wall inclined portion 5*b*1 is provided with an end plate inclined portion 3*a*1 (refer to FIG. 1A) which is inclined in accordance with an inclination of the wall inclined portion 5*b*1. A continuously inclined portion is constituted by the wall inclined portion 5*b*1 and the end plate inclined portion 3*a*1. Similarly, a wall inclined portion 3*b*1 whose height is continuously inclined from the outer peripheral side toward the inner peripheral side is also provided on the wall 3*b* of the fixed scroll 3, and an end plate inclined portion 5*a*1 facing a tooth tip of the wall inclined portion 3*b*1 is provided on the end plate 5*a* of the orbiting scroll 5.

In addition, the meaning of the continuity in the inclined portion in the present embodiment is not limited to a smoothly connected inclined portion but also includes an inclined portion in which small steps inevitably generated during processing are connected in a staircase and the inclined portion is continuously inclined as a whole. However, the inclined portion does not include a large step such as a so-called stepped scroll.

Coating is applied to the wall inclined portions 3*b*1 and 5*b*1 and/or the end plate inclined portions 3*a*1 and 5*a*1. For example, the coating includes manganese phosphate processing, nickel phosphorus plating, or the like.

As shown in FIG. 2, wall flat portions 5*b*2 and 5*b*3 each having a constant height are respectively provided on the innermost peripheral side and the outermost peripheral side of the wall 5*b* of the orbiting scroll 5. Each of the wall flat portions 5*b*2 and 5*b*3 is provided over a region of 180° around a center O2 (refer to FIG. 1A) of the orbiting scroll 5. Wall inclined connection portions 5*b*4 and 5*b*5 which become curved portions are respectively provided at positions at which the wall flat portions 5*b*2 and 5*b*3 and the wall inclined portion 5*b*1 are connected to each other.

Similarly, the tooth bottom of the end plate 5*a* of the orbiting scroll 5 is also provided with end plate flat portions 5*a*2 and 5*a*3 each having a constant height. Each of the end plate flat portions 5*a*2 and 5*a*3 is provided over a region of 180° around the center of the orbiting scroll 5. End plate inclined connection portions 5*a*4 and 5*a*5 which become curved portions are respectively provided at positions at which the end plate flat portions 5*a*2 and 5*a*3 and the end plate inclined portion 5*a*1 are connected to each other.

Figure 3:
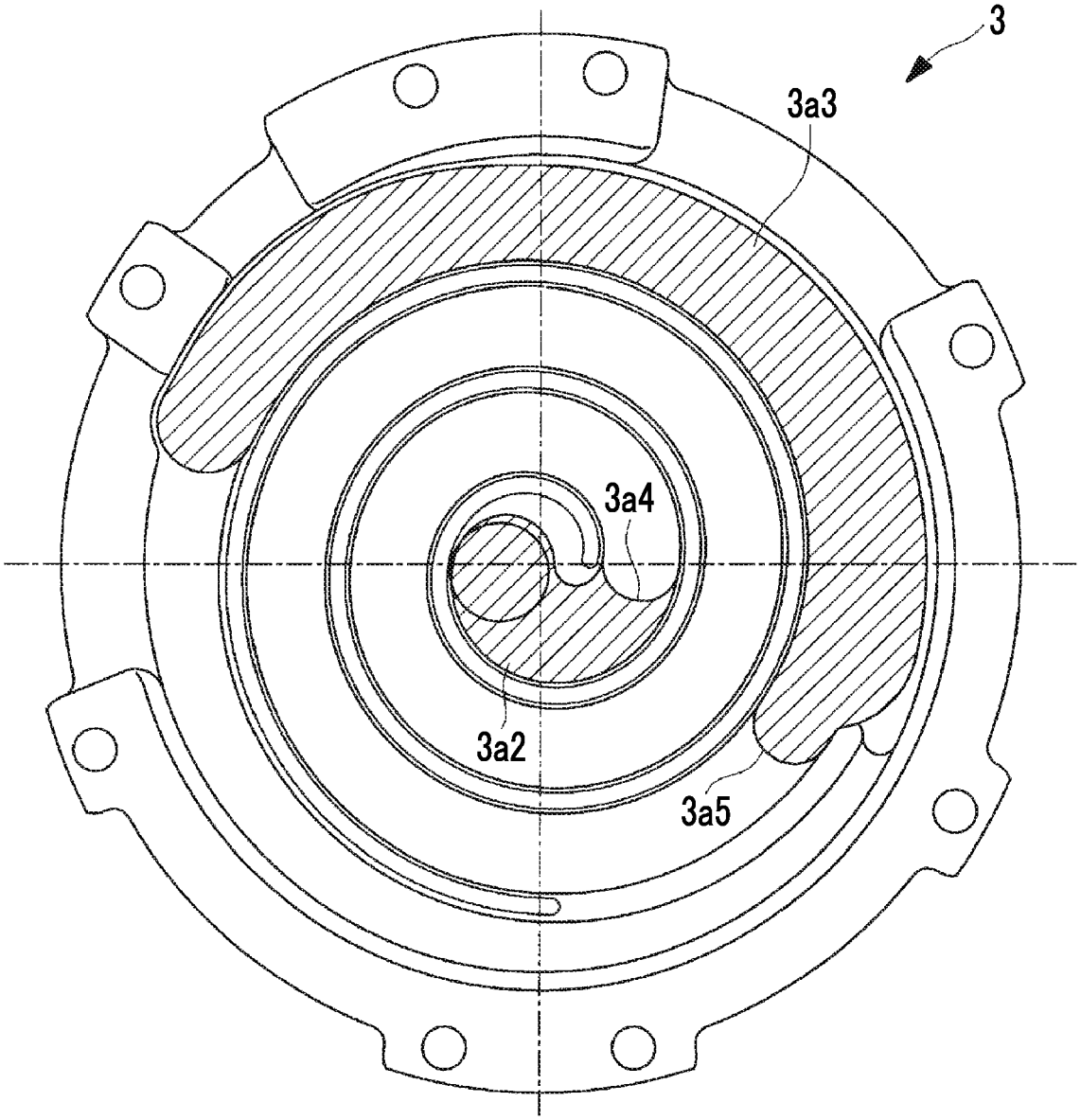
FIG. 3 is a plan view showing an end plate flat portion provided in the fixed scroll.
Figure 4:
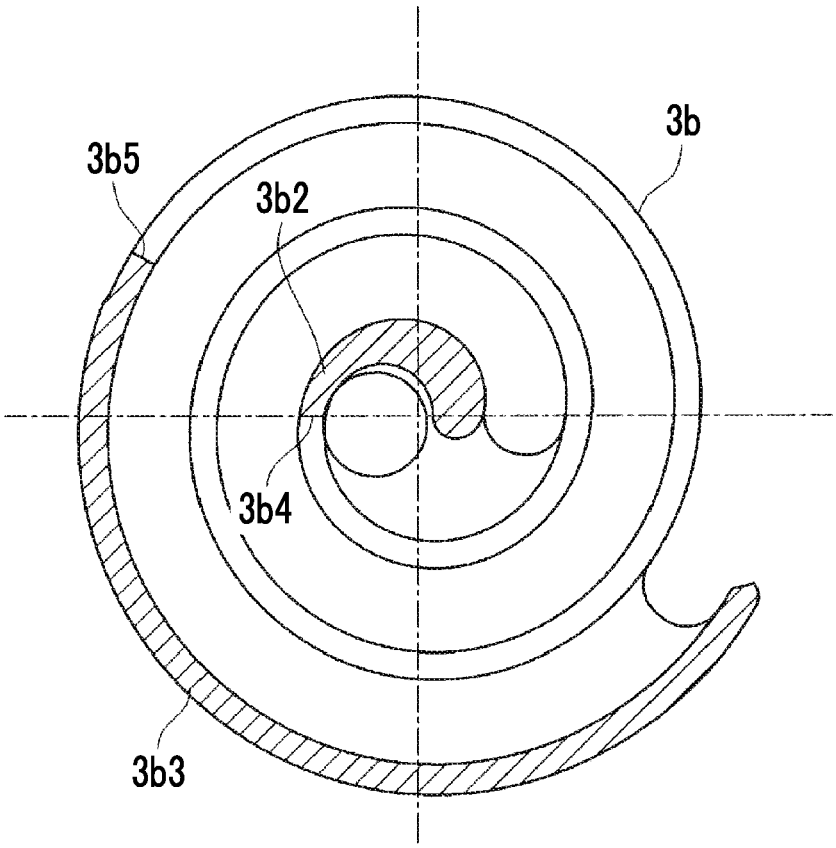
FIG. 4 is a plan view showing a wall flat portion provided in the fixed scroll.

As shown by hatching in FIGS. 3 and 4, similarly to the orbiting scroll 5, the fixed scroll 3 is also provided with end plate flat portions 3*a*2 and 3*a*3, wall flat portions 3*b*2 and 3*b*3, end plate inclined connection portions 3*a*4 and 3*a*5, and wall inclined connection portions 3*b*4 and 3*b*5.

Figure 5:
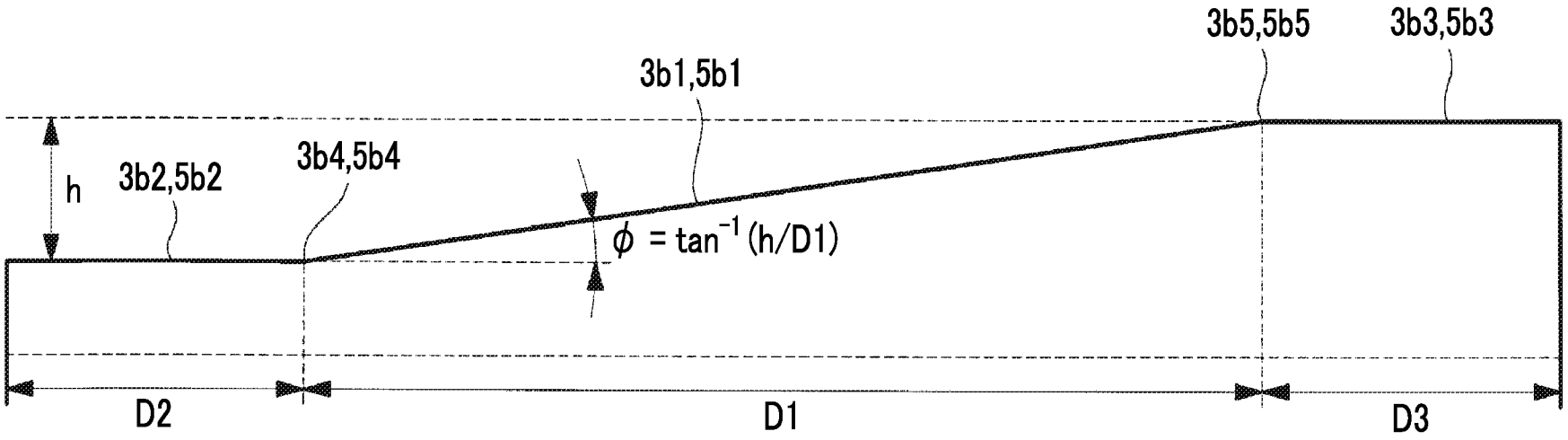
FIG. 5 is a schematic view showing a wall which is displayed to extend in a spiral direction.

FIG. 5 shows the walls 3*b* and 5*b* which are displayed to extend in a spiral direction. As shown in FIG. 5, the wall flat portions 3*b*2 and 5*b*2 on the innermost peripheral side are provided over a distance D2, and the wall flat portions 3*b*3 and 5*b*3 on the outermost peripheral side are provided over a distance D3. Each of the distance D2 and the distance D3 is a length equivalent to a region having 180° (180° or more and 360° or less, preferably 210° or less) around each of the centers O1 and O2 of the respective scrolls 3 and 5. The wall inclined portions 3*b*1 and 5*b*1 are provided over the distance D1 between the wall flat portions 3*b*2 and 5*b*2 on the innermost peripheral side and the wall flat portions 3*b*3 and 5*b*3 on the outermost peripheral side. If a height difference between each of the wall flat portions 3*b*2 and 5*b*2 on the innermost peripheral side and each of the wall flat portions 3*b*3 and 5*b*3 on the outermost peripheral side is defined as h, an inclination φ of each of the wall inclined portions 3*b*1 and 5*b*1 is represented by the following Expression.

$$\varphi=\tan^{-1}(h/D1) \quad (1)$$

In this way, the inclination φ of the inclined portion is constant in a circumferential direction in which each of the spiral walls 3*b* and 5*b* extends. Additionally, the distance D1 is longer than the distance D2 and longer than the distance D3.

For example, in the present embodiment, the specifications of the scrolls 3 and 5 are as follows.

Figure 6:
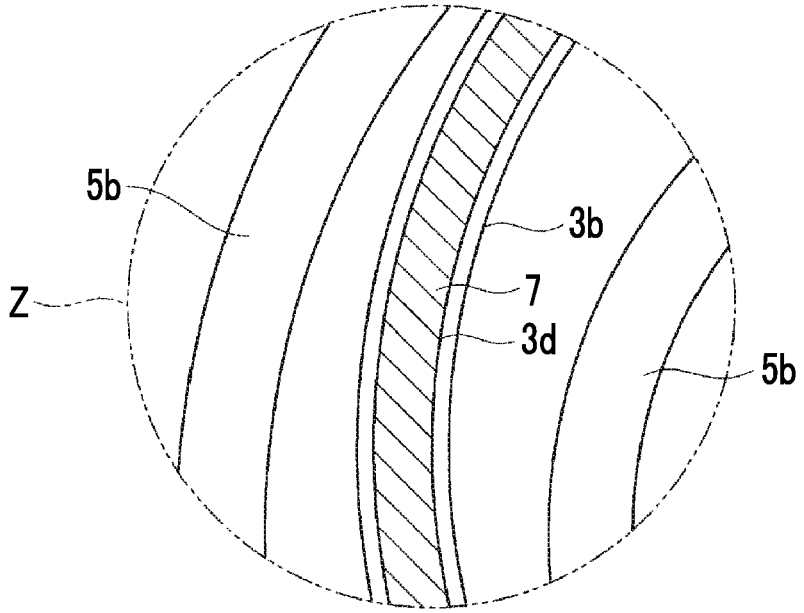
FIG. 6 is a partially enlarged view showing a region indicated by a reference sign Z in FIG. 1B in an enlarged manner.

(1) Orbiting radius ρ [mm]: 2 or more and 15 or less, preferably 3 or more and 10 or less (2) Number of turns of the walls 3*b*, 5*b*: 1.5 or more and 4.5 or less, preferably 2.0 or more and 3.5 or less (3) Height difference h [mm]: 2 or more and 20 or less, preferably 5 or more and 15 or less (4) h/Lout (Wall height on outermost peripheral side):

0.05 or more and 0.35 or less, preferably 0.1 or more and 0.25 or less (5) Angle range [°] of the inclined portions (angle range equivalent to the distance D1):

180 or more and 1080 or less, preferably 360 or more and 720 or less (6) Angle φ [°] of the inclined portions: 0.2 or more and 4 or less, preferably 0.5 or more and 2.5 or less FIG. 6 is an enlarged view showing a region indicated by a reference sign Z in FIG. 1B in an enlarged manner. As shown in FIG. 6, the tooth tip of the wall 3*b* of the fixed scroll 3 is provided with a tip seal 7. The tip seal 7 is made of resin and contacts the tooth bottom of the end plate 5*a* of the orbiting scroll 5 facing the tip seal 7 to seal the fluid. The tip seal 7 is accommodated within a tip seal groove 3*d* which is formed on the tooth tip of the wall 3*b* in the circumferential direction. A compressed fluid enters the tip seal groove 3*d*, presses the tip seal 7 from a rear surface thereof to push out the tip seal 7 toward the tooth bottom side, thereby bringing the tip seal 7 into contact with the facing the tooth bottom. In addition, a tooth tip of the wall 5*b* of the orbiting scroll 5 is similarly provided with a tip seal 7.

Figure 7A:
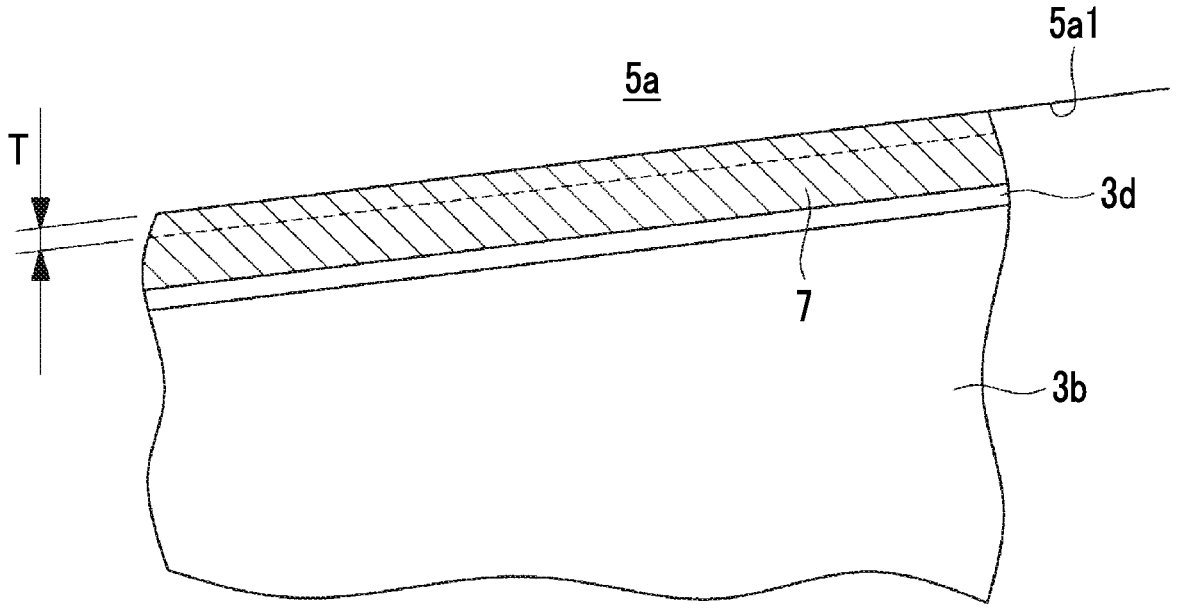
FIG. 7A is a side view showing a tip seal clearance of a portion shown in FIG. 6 and a state where the tip seal clearance is relatively smaller.
Figure 7B:
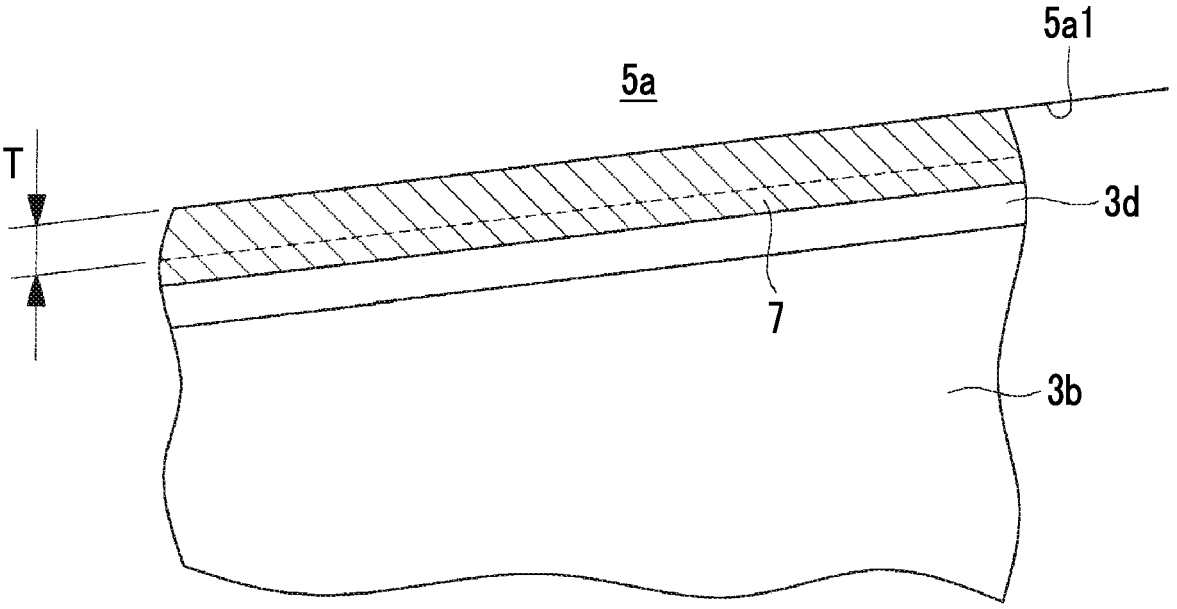
FIG. 7B is a side view showing the tip seal clearance of the portion shown in FIG. 6 and a state where the tip seal clearance is relatively larger.

If both the scrolls 3 and 5 perform the revolution orbiting movement relative to each other, the positions of the tooth tip and the tooth bottom are relatively deviated by an orbiting diameter (orbiting radius ρ×2). In the inclined portion, the tip clearance between the tooth tip and the tooth bottom is changed due to the positional deviation between the tooth tip and the tooth bottom. A tip clearance change amount Δh [mm] is, for example, 0.05 or more and 1.0 or less, preferably 0.1 or more and 0.6 or less. For example, in FIG. 7A, a tip clearance T is small, and in FIG. 7B, the tip clearance T is large. Even when the tip clearance T is changed by an orbiting movement, the tip seal 7 is pressed toward the tooth bottom side of the end plate 5*a* by the compressed fluid from the rear surface. Thus, the tip seal 7 can follow the tooth bottom so as to perform sealing for the tooth bottom.

The above-described scroll compressor 1 is operated as follows.

The orbiting scroll 5 performs the revolution orbiting movement around the fixed scroll 3 by a drive source such as an electric motor (not shown). As a result, the fluid is sucked from the outer peripheral sides of the respective scrolls 3 and 5, and the fluid is taken into the compression chambers surrounded by the respective walls 3*b* and 5*b* and the respective end plates 3*a* and 5*a*. The fluid in the compression chambers is sequentially compressed while being moved from the outer peripheral side toward the inner peripheral side, and finally, the compressed fluid is discharged from the discharge port 3*c* formed in the fixed scroll 3. When the fluid is compressed, the fluid is compressed in the height directions of the walls 3*b* and 5*b* in the inclined portions formed by the end plate inclined portions 3*a*1 and 5*a*1 and the wall inclined portions 3*b*1 and 5*b*1, and thus, three-dimensional compression is performed.

As described above, according to the scroll compressor 1 of the present embodiment, the following operational effects are exhibited.

Since the inclined portions are provided in which the inter-facing surface distance L between the end plates 3*a* and 5*a* continuously decreases from the outer peripheral side to the inner peripheral side of the walls 3*b* and 5*b*, the three-dimensional compression is possible and the size reduction can be realized.

Moreover, since the inclined portions decrease continuously, the fluid leakage can be reduced as compared to the related-art stepped scroll fluid machine in which the step portions are provided on the walls and the tooth bottoms.

Since the tip seal 7 is provided at the tooth tip of each of the walls 3*b* and 5*b*, even if the tip clearance T (refer to FIG. 7) between the tooth tip and the tooth bottom in each inclined portion changes in accordance with the orbiting movement, the tip seal 7 can be made to follow, and the fluid leakage can be suppressed.

The wall inclined portions 3*b*1 and 5*b*1 and/or the end plate inclined portions 3*a*1 and 5*a*1 that constitute the inclined portions are coated. As a result, it is possible to compensate for the processing variation of the inclined portions, which are difficult to obtain the processing accuracy, by the thickness of a coating film, and it is possible to further suppress the fluid leakage.

The wall flat portions 3*b*2, 3*b*3, 5*b*2, and 5*b*3 and the end plate flat portions 3*a*2, 3*a*3, 5*a*2, and 5*a*3 are provided on the outermost peripheral portions and the innermost peripheral portions of the walls 3*b* and 5*b* and the end plates 3*a* and 5*a*. As a result, it is possible to avoid the difficulty of setting measurement points and improving the measurement accuracy in a case where the tooth tips of the walls are inclined, and to perform shape measurement with high accuracy. Then, the dimensional management of the scroll shape and the tip clearance management become easy.

By providing the wall flat portions 3*b*2, 3*b*3, 5*b*2, and 5*b*3 and the end plate flat portions 3*a*2, 3*a*3, 5*a*2, and 5*a*3 over the region of 180°, the measurement can be performed on the flat portions on both sides across the centers 01 and 02 of the scrolls 3 and 5. As a result, the shape dimensions of the scroll members can be appropriately measured.

Additionally, in a case where the range of the flat portions greatly exceeds 180°, the regions of the inclined portions decrease and the inclination φ of the inclined portions becomes large. In a case where the inclination φ becomes large, there is a possibility that the amount of change in the tip clearance T caused by the orbiting diameter during the revolution orbiting movement becomes large and the fluid leakage increases. Therefore, the wall flat portions 3*b*2, 3*b*3, 5*b*2, and 5*b*3 and the end plate flat portions 3*a*2, 3*a*3, 5*a*2, and 5*a*3 are regions of 180°. However, this 180° is not strict, and an angle slightly exceeding 180° (for example, about 30°) is allowed within a range where the fluid leakage does not increase.

The inclination φ of the inclined portions is set to be constant with respect to the circumferential direction in which the spiral walls 3*b* and 5*b* extend. As a result, the tip clearance T caused by the orbiting diameter during the revolution orbiting movement can be made equal at the respective positions of the inclined portions, and the fluid leakage can be suppressed.

In addition, the present embodiment can be modified as follows.

Figure 8:
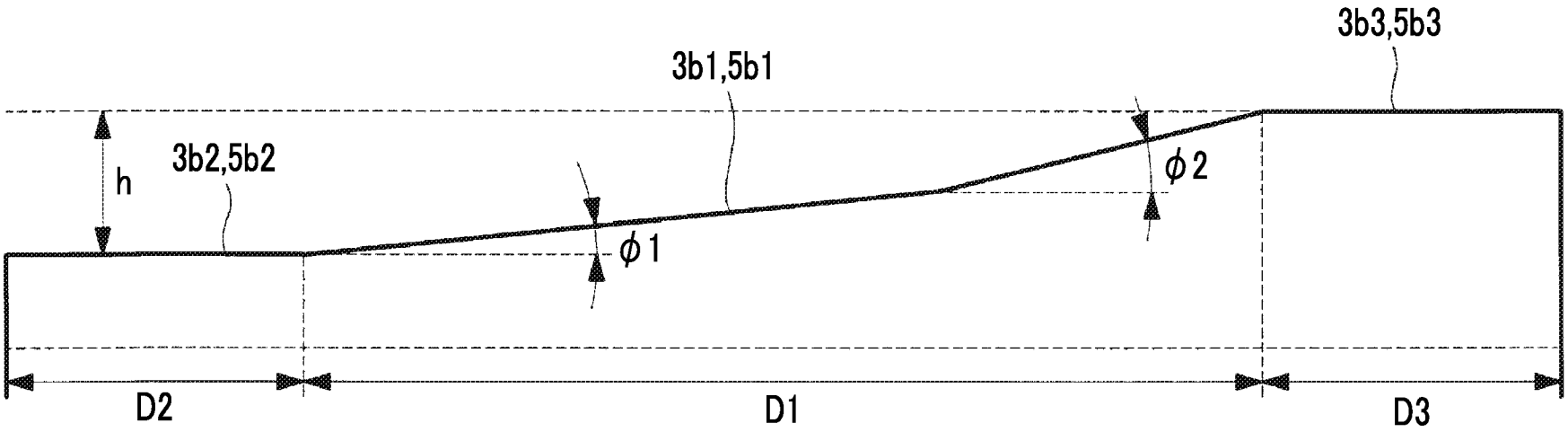
FIG. 8 is a schematic view showing a modification example of FIG. 5.

As shown in FIG. 8, the inclination φ of the inclined portions may be set such that the inclination φ2 on the outer peripheral side is larger than the inclination φ1 on the inner peripheral side with respect to the circumferential direction in which the spiral walls 3*b* and 5*b* extend. As a result, it is possible to suppress the fluid leakage on the inner peripheral side where the pressure difference of the fluid is larger than that on the outer peripheral side while suppressing the fluid leakage on the outer peripheral side where the pressure difference of the fluid is smaller than that on the inner peripheral side to a necessary minimum. As a result, the volume ratio can be increased, and the amount of displacement can also be increased.

Additionally, instead of changing the inclination φ stepwise as shown in FIG. 8, the inclination φ may be continuously increased from the inner peripheral side toward the outer peripheral side.

In the present embodiment, the end plate inclined portions 3*a*1 and 5*a*1 and the wall inclined portions 3*b*1 and 5*b*1 are provided on both the scrolls 3 and 5. However, they may be provided in any one of the scrolls 3 and 5.

Figure 9A:
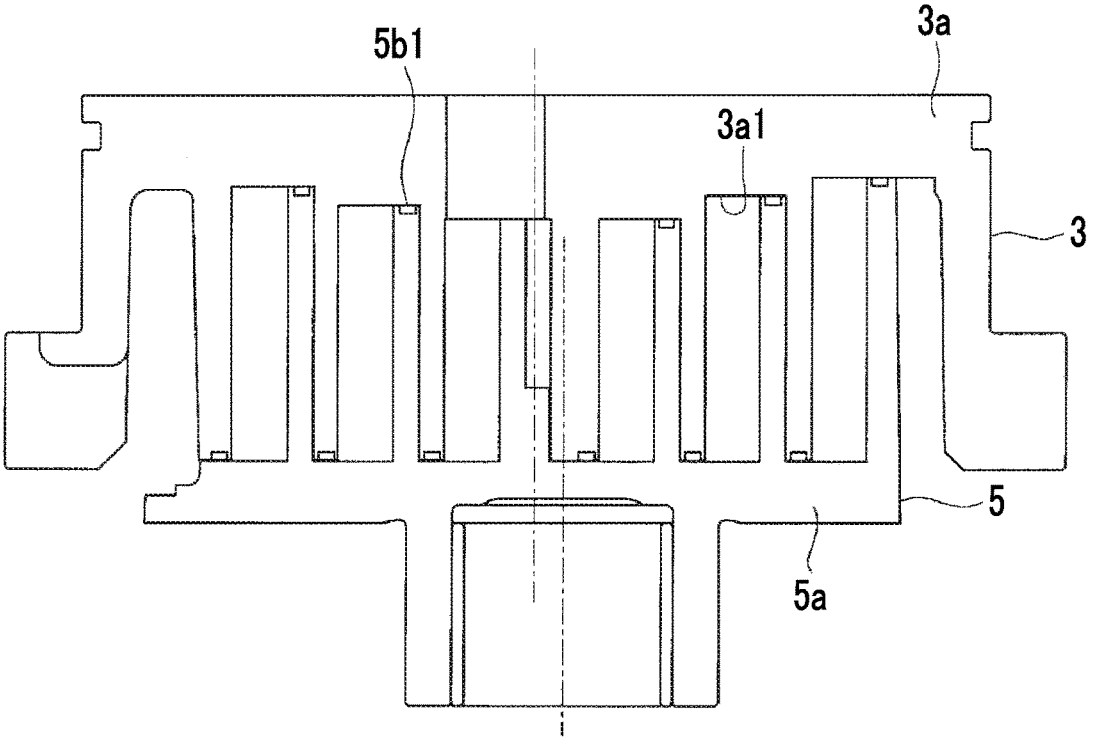
FIG. 9A is a longitudinal sectional view showing a modification example of the embodiment and showing a combination with a scroll having no step portion.

Specifically, as shown in FIG. 9A, in a case where the wall (for example, orbiting scroll 5) on one side is provided with the wall inclined portion 5*b*1 and the end plate 3*a* on the other side is provided with the end plate inclined portion 3*a*1, the wall on the other side and the end plate 5*a* on one side may be flat.

Figure 9B:
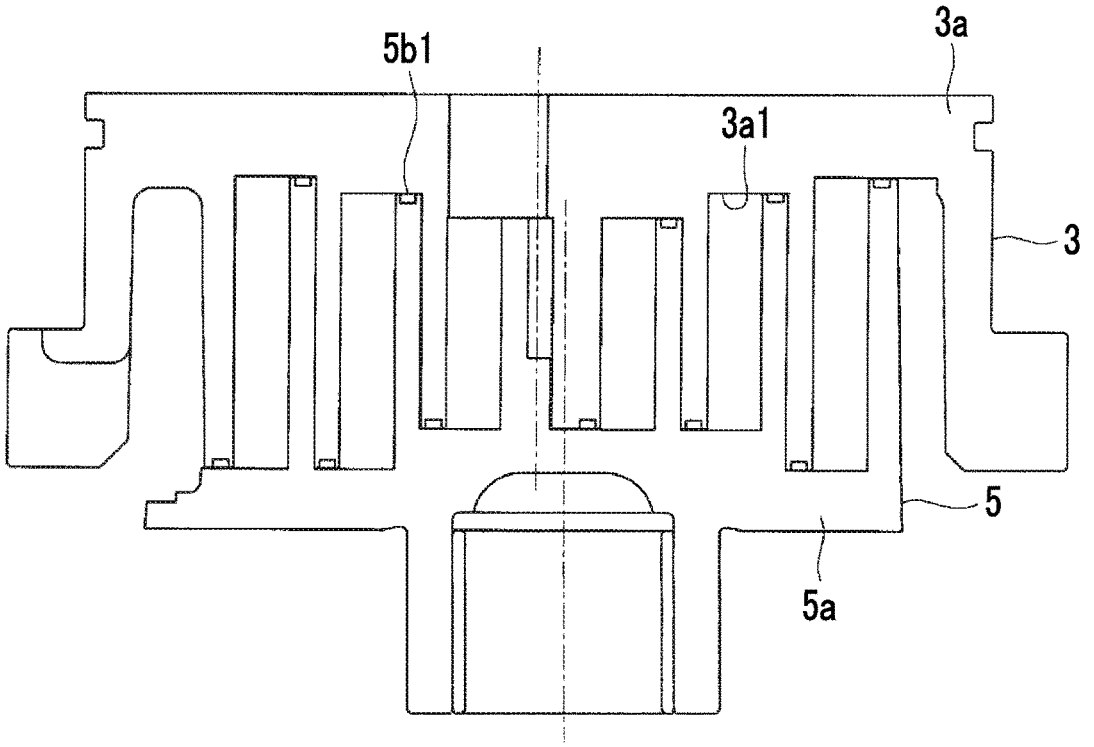
FIG. 9B is a longitudinal sectional view showing a modification example of the embodiment and showing a combination with a stepped scroll.

Additionally, as shown in FIG. 9B, a shape combined with a stepped shape of the related art may be adopted, that is, the shape in which the end plate inclined portion 3*a*1 is provided in the end plate 3*a* of the fixed scroll 3 may be combined with a shape in which a step portion is provided in the end plate 5*a* of the orbiting scroll 5.

In the present embodiment, the wall flat portions 3*b*2, 3*b*3, 5*b*2, and 5*b*3 and the end plate flat portions 3*a*2, 3*a*3, 5*a*2, and 5*a*3 are provided. However, the flat portions on the inner peripheral side and/or the outer peripheral side may be omitted, and the inclined portions may be provided so as to extend to the entire walls 3*b* and 5*b*.

Additionally, in the present embodiment, the scroll compressor is described. However, the present invention can be applied to a scroll expander which is used as an expander.

REFERENCE SIGNS LIST

1: scroll compressor (scroll fluid machine)
3: fixed scroll (first scroll member)
3*a*: end plate (first end plate)
3*a*1: end plate inclined portion
3*a*2: end plate flat portion (inner peripheral side)
3*a*3: end plate flat portion (outer peripheral side)
3*a*4: end plate inclined connection portion (inner peripheral side)
3*a*5: end plate inclined connection portion (outer peripheral side)
3*b*: wall (first wall)
3*b*1: wall inclined portion
3*b*2: wall flat portion (inner peripheral side)
3*b*3: wall flat portion (outer peripheral side)
3*b*4: wall inclined connection portion (inner peripheral side)
3*b*5: wall inclined connection portion (outer peripheral side)
3*c*: discharge port
3*d*: tip seal groove
5: orbiting scroll (second scroll member)
5*a*: end plate (second end plate)
5*a*1: end plate inclined portion
5*a*2: end plate flat portion (inner peripheral side)
5*a*3: end plate flat portion (outer peripheral side)
5*b*: wall (second wall)
5*b*1: wall inclined portion
5*b*2: wall flat portion (inner peripheral side)
5*b*3: wall flat portion (outer peripheral side)
5*b*4: wall inclined connection portion (inner peripheral side)
5*b*5: wall inclined connection portion (outer peripheral side)
7: tip seal
L: inter-facing surface distance
T: tip clearance
φ: inclination

The invention claimed is:

1. A scroll fluid machine comprising:

a first scroll member having a first end plate on which a spiral first wall is provided;

a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from an outer peripheral sides of the first wall and the second wall toward inner peripheral sides thereof, wherein the inclined portion is provided over a range of 180° or more around a center of the spiral, wherein outermost peripheral portions and/or innermost peripheral portions of the first wall and the second wall are provided with a wall flat portion whose height does not change, wherein each of the first end plate and the second end plate is provided with an end plate flat portion corresponding to the wall flat portion, and wherein the wall flat portion and the end plate flat portion are provided over a region of 180° around a center of the scroll member.

2. The scroll fluid machine according to claim 1, wherein at least one of the first wall and the second wall has a wall inclined portion in which a height of the wall continuously decreases from the outer peripheral side toward the inner peripheral side so as to form the inclined portion, and wherein at least one of the first end plate and the second end plate has an end plate inclined portion in which a tooth bottom surface facing a tooth tip of the wall inclined portion is inclined in accordance with an inclination of the wall inclined portion.

3. The scroll fluid machine according to claim 1, wherein a tooth tip of each of the first wall and the second wall corresponding to the inclined portion is provided with a tip seal that comes into contact with a facing tooth bottom to seal a fluid.

4. The scroll fluid machine according to claim 1, wherein a coating is applied to a tooth tip of the wall and/or a tooth bottom of the end plate that constitutes the inclined portion.

5. The scroll fluid machine according to claim 1, wherein an inclination of the inclined portion is constant with respect to a circumferential direction in which the spiral wall extends.

6. The scroll fluid machine according to claim 1, wherein an inclination of the inclined portion is set to be larger on the outer peripheral side than on the inner peripheral side with respect to a circumferential direction in which the spiral wall extends.

7. A scroll member used for a scroll fluid machine including an end plate and a spiral wall provided on the end plate, wherein the wall has a wall inclined portion in which a height of the wall continuously decreases from an outer peripheral side toward an inner peripheral side, wherein the end plate has an end plate inclined portion in which a height of the end plate continuously increases from the outer peripheral side toward the inner peripheral side in accordance with a decrease in height of the wall inclined portion, wherein the wall inclined portion and the end plate inclined portion are provided over a range of 180° or more around a center of the spiral, wherein outermost peripheral portions and/or innermost peripheral portions of the wall are provided with a wall flat portion whose height does not change, and/or outermost peripheral portions and/or innermost peripheral portions of the end plate are provided with an end plate flat portion whose height does not change, and wherein the wall flat portion and/or the end plate flat portion are provided over a region of 180° around a center of the scroll member.

* * * * *